US005490738A

United States Patent [19]

Pearce

[11] Patent Number: 5,490,738

[45] Date of Patent: Feb. 13, 1996

[54] DRAWING IMPLEMENT

[76] Inventor: James M. Pearce, 7621 S. Bermuda, Las Vegas, Nev. 89123

[21] Appl. No.: 331,209

[22] Filed: Oct. 28, 1994

[51] Int. Cl.[6] ..... B43K 8/20

[52] U.S. Cl. ..... 401/208; 401/48; 401/81; 401/220

[58] Field of Search ..... 401/208, 51, 48, 401/81, 220

[56] References Cited

U.S. PATENT DOCUMENTS

| | | | |
|---|---|---|---|
| 637,832 | 11/1899 | Rosenberg | 401/208 |
| 833,964 | 10/1906 | Herman | 401/208 |
| 852,214 | 4/1907 | Beckmann | 401/208 |
| 3,179,089 | 4/1965 | Civitarese | 401/48 X |

FOREIGN PATENT DOCUMENTS

| | | | |
|---|---|---|---|
| 192655 | 12/1907 | Germany | 401/48 |
| 63187 | 9/1913 | Germany | 401/208 |
| 53265 | 7/1910 | Switzerland | 401/220 |
| 184830 | 6/1936 | Switzerland | 401/208 |

*Primary Examiner*—Steven A. Bratlie
*Attorney, Agent, or Firm*—Quirk & Tratos

[57] ABSTRACT

A device is provided for transferring crayon or similar drawing material onto a surface. The device comprises an elongate tubular housing for housing a crayon, a transfer wheel, and a number of gears for rotating the crayon with respect to the wheel. The transfer wheel rotates about an axle riding on forks extending from the housing. An inner sleeve is located in the housing and contains the crayon. Gears located on the axle, fork, and sleeve rotate the sleeve when the wheel is driven along a surface. Rotation of the sleeve rotates the crayon, causing the transfer wheel to remove crayon material uniformly from the end of the crayon. Spring loaded offset locking rods press the crayon into engagement with the wheel and lock it in the sleeve.

19 Claims, 3 Drawing Sheets

DRAWING IMPLEMENT

FIELD OF THE INVENTION

The present invention relates to a writing or drawing implement. In particular, the present invention relates to a device which is useful in transferring crayon or solid or semi-solid drawing material, especially those having a wax or similar base, or pencil lead, to a drawing surface.

BACKGROUND OF THE INVENTION

Crayons, or other drawing utensils comprising wax or similar materials, such as those manufactured and sold under the mark CRAYOLA®, are a popular drawing instruments. Crayons typically comprise a solid rod-shaped body made up entirely of waxy material. Most often, the material contains various color pigments. Further, a paper or plastic wrapper is usually located about a portion of the exterior of the crayon, in order to prevent the material from contacting the user or other undesired surfaces.

Because crayon material is fairly soft, a user can easily transfer it to most surfaces simply by pressing the crayon into engagement with the surface and moving it. The friction resulting during the movement of the crayon causes transfer of material from the crayon to the desired surface.

Because the crayon is rod-shaped, and often about 7 mm to 8 mm in diameter, it is difficult for a user to control the amount of material transferred to a drawing surface. For example, a user wishing to draw a thin line with a crayon tips the crayon on edge to present the "edge" located at the intersection of the outer cylindrical surface and the end of the crayon. After moving the crayon a short distance, however, the edge becomes flat from the material transfer, causing a wider line to be drawn.

Users often sharpen or taper one end of the crayon so that material may be more selectively placed, such as when the user draws thin lines. Once again, however, use of the crayon for a short time results in transfer of enough crayon material that the tapered area is worn off, exposing a larger surface area of material for transfer.

Users of crayons also often wish to draw complex shapes and patterns with crayons. Unfortunately, because of the problems described above, drawing of thin lines and complex shapes is extremely difficult. Further, it is not possible to use stencils or patterns to draw patterns with crayons, because, unlike ink pens or pencils, the large size of the crayon prevents it from passing through the stencil or other pattern.

For these reasons, users of crayons desire an improved means for transferring crayon material to a drawing surface.

SUMMARY OF THE INVENTION

In accordance with the present invention, an improved drawing implement is provided. The implement of the present invention is particularly useful in transferring a drawing crayon material to a drawing surface.

The preferred embodiment of the present invention comprises a housing for holding a crayon therein, means for rotating the crayon, and a transfer wheel for transferring material from the crayon to the drawing surface. The housing is a tubular body having first and second end portions. The means for rotating preferably includes gear means and an inner sleeve located in said housing for containing the crayon.

The inner sleeve includes a second end portion having a gear thereon which is located adjacent to the second end portion of the housing. The transfer wheel is preferably located on an axle supported between two forks extending from the housing. In one form the transfer wheel includes a sleeve thereon which may include a pattern.

The gear means preferably includes a gear located on the axle with the transfer wheel, and two gears located in axial arrangement on one of the forks which engage the gear on the axle, and the gear on the sleeve. These gears translate the rolling motion of the transfer wheel across the drawing surface into rotational movement of the inner sleeve and crayon therein which are located in the housing.

As a further aspect of the present invention, the implement includes means for locking a crayon in the sleeve and against the transfer wheel. The means for locking preferably comprises two connected rods for location in the sleeve, one of the rods including an end having a spring and crayon holder attached thereto for engagement against the crayon. The two rods are connected via an offset pin, creating a cam mechanism. The pin allows a user to move the rods from a first position in which they are aligned with one another, to a second position in which they are offset from one another.

A user of the implement places a crayon in the inner sleeve. The user then inserts the rods into the sleeve in their aligned position, pressing the crayon holder against the crayon until the spring begins to compress. The user then turns the first rod, causing it to move out of alignment with the other rod, frictionally wedging them in the sleeve.

The user then moves the transfer wheel along the drawing surface. As the wheel moves it picks up crayon material and transfers it to the drawing surface. Further, as the wheel moves, the means for rotating causes the crayon to be rotated about a longitudinal axis as the material is removed by the wheel. This rotational movement causes the wheel to remove crayon material at a uniform rate across the entire bottom surface of the crayon, preventing the wheel from forming a groove in the crayon.

In a second form of the present invention, the forks which support the axle form a removable support member. This member preferably has located thereon the three gears, the axle, and the transfer wheel, and is selectively removable from the housing. Preferably, the support member includes a locking groove for engaging a pin on the housing for locking the support member to the housing.

In the second form of the present invention, a user can remove the transfer wheel and interchange it with another for location on the housing. A user can also replace the crayon quickly by removing the wheel.

Further objects, features, and advantages of the present invention will become apparent from the detailed description of the drawings which follows, when considered with the attached figures.

DETAILED DESCRIPTION OF THE PREFERRED EMBODIMENT

Figure 1:
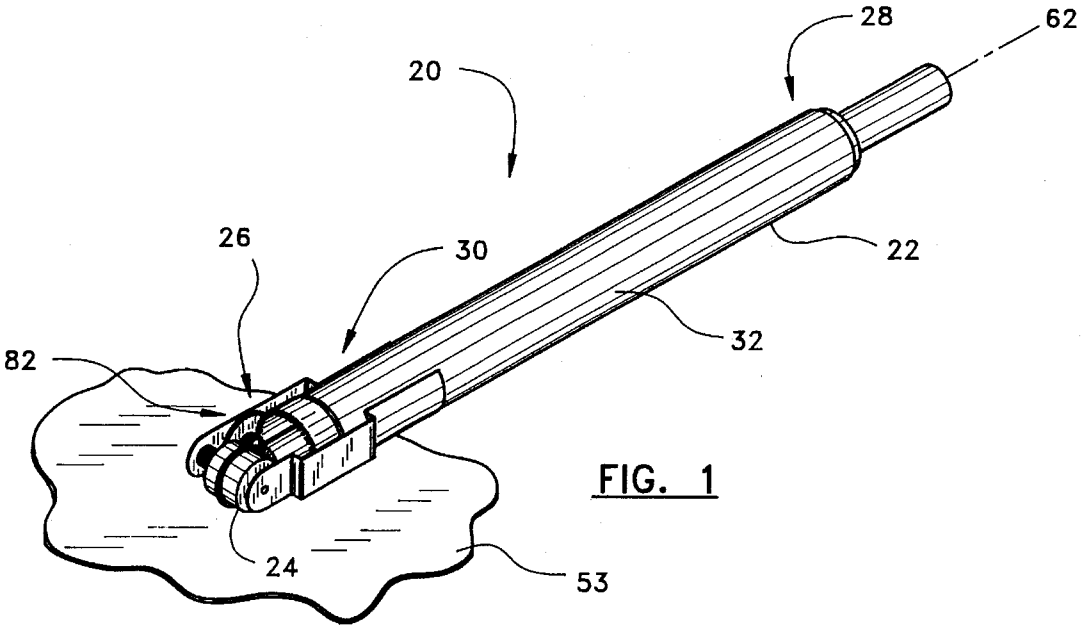
FIG. 1 is a perspective view of a drawing implement of the present invention.

FIGS. 1–4 illustrate a drawing implement 20 which comprises a housing 22 for containing a crayon 23, a transfer wheel 24, and means 26 for rotating the crayon 23 with respect to the wheel 24. As used herein, the term crayon is meant to include any solid or semi-solid drawing material, especially those having a wax or similar base, or pencil lead or other similar drawing/writing material.

The housing 22 is an elongate, hollow cylindrical sleeve having a first end portion 28, second end portion 30, an outer surface 32, and an inner surface 34. Preferably, the housing 22 is about 13–14 cm long, and about 13–14 mm in diameter. The housing 22 may be made of any strong, fairly rigid material, such as metal or plastic. An imaginary centerline 62 runs axially along the length of the housing 22 from end portion to end portion 28,30. As used herein, "longitudinal" refers to the direction generally parallel to the centerline 62, and "transverse" refers to the direction generally perpendicular to the centerline 62, or the radial direction.

The transfer wheel 24 is preferably cylindrical. As illustrated in FIG. 1, the wheel 24 is about 18–20 mm long and about 10–15 mm in diameter. The width of the wheel 24 may vary substantially, and can be as little as about 1–2 mm wide. The wheel 24 may be solid or hollow, and can be made of numerous materials such as plastic or metal. No matter how the wheel 24 is constructed, however, it should be sufficient rigid so that it is not flattened during use.

As described in more detail below, the wheel 24 acts as the transfer mechanism for the crayon material. For this reason, the characteristics of the wheel 24 must be chosen carefully. First, the wheel 24 must be constructed of a material such that, when considering the width of the wheel, the wheel will turn when used. In particular, if the wheel 24 is wide as compared to the width of the crayon 23, the wheel may be difficult to turn with respect to the drawing surface 53 during use.

The wheel 24 must be constructed of a material which adequately picks up crayon material and transfers it to a drawing surface 53. For example, crayon material does not transfer and adhere as easily to some smoothly polished metals as it does to other surfaces.

Figure 2:
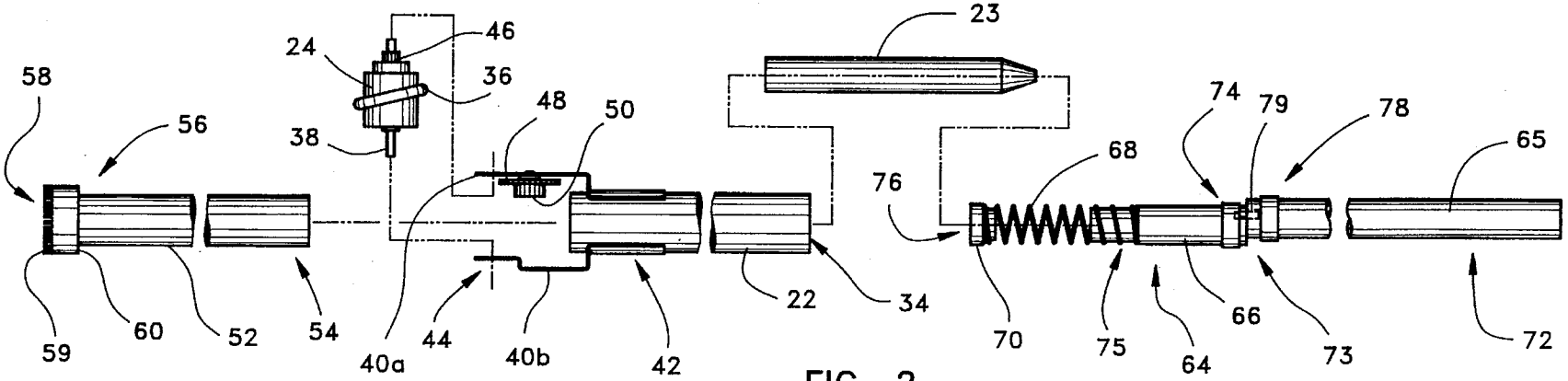
FIG. 2 is an exploded view of the drawing implement of FIG. 1.
Figure 3:
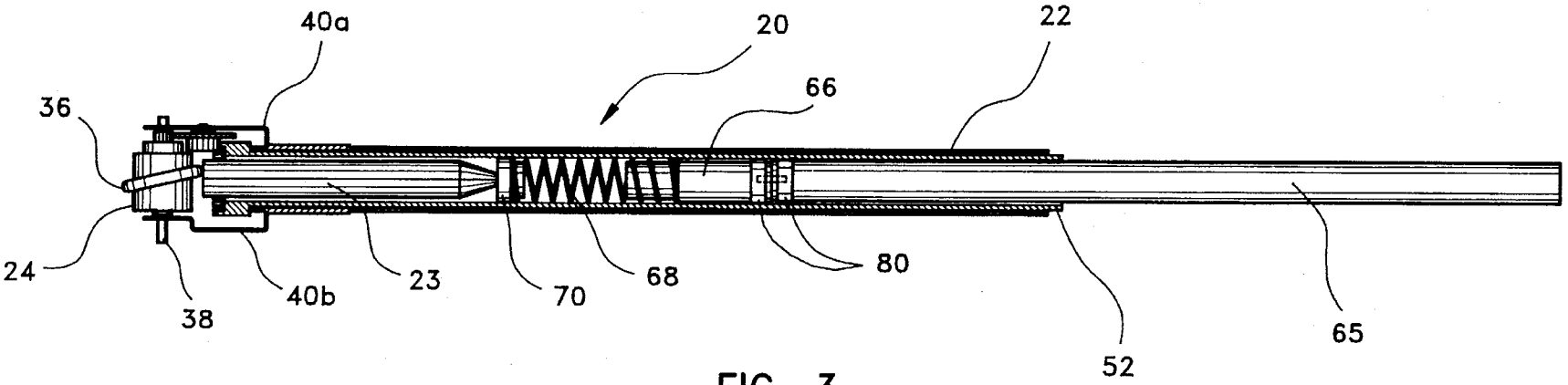
FIG. 3 is a cross-sectional side view of the drawing implement of FIG. 1.
Figure 4:
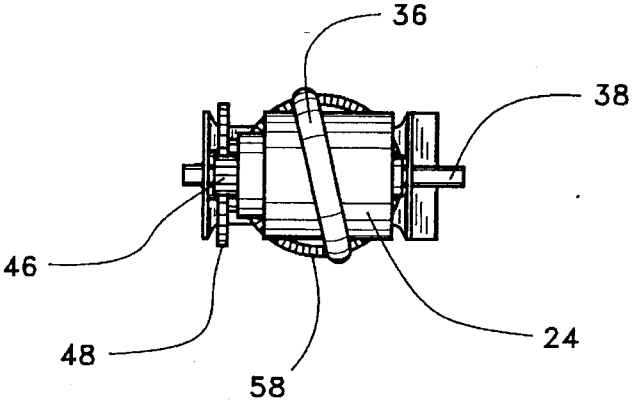
FIG. 4 is an end view of the drawing implement of FIG. 1.

In the preferred form of the present invention, a special transfer sleeve 36 is located on the wheel 24. As best illustrated in FIGS. 1, 2 and 3 for use in drawing thin lines, this sleeve 36 is a circular rubber gasket. If thicker lines are to be drawn, a wider sleeve 36 can be located on the wheel 24. Further, and most advantageously, patterns can be drawn by locating a patterned sleeve 36 over the wheel 24. The sleeve 36 is preferably a sticky or high friction material such as plastic or rubber, and can be quite thin as compared to the diameter of the wheel 24.

The wheel 24 preferably rotates on an axle 38 mounted between two forks **40*a,b* connected to the housing 22. The axle 38 is preferably a small metal pin which passes through the wheel 24**.

As illustrated, the axle 38 is mounted transverse to the housing 22, so that the axis of rotation of the wheel 24 is also transverse to the centerline 62 of the housing 22. The forks **40*a,b* are flat strips, preferably made of metal, which have first end portions 42 connected to the second end portion 30 of the housing 22. The forks 40*a,b* also include a free second end portion 44, which preferably extends about 2–2.5 cm from the end of the housing 22**.

Each fork **40*a,b* is preferably arcuate shaped its first end portion 42 for mating engagement with the outer surface 32 of the housing 22. When the housing 22 and forks 40*a,b* are made of metal, the forks may be brazed or welded to the housing 22. On the other hand, the forks 40*a,b* and housing 22** may be manufactured as one piece, such as by molding.

Preferably, means 26 for rotating the crayon 23 with respect to the wheel 24 are provided. In the preferred form, the means 26 for rotating comprises gear means 82 and an inner sleeve 52.

The sleeve 52 is a tubular body having an inner diameter slightly larger than the outer diameter of a crayon 23, and an outer diameter slightly smaller than the inner diameter of the housing 22. The sleeve 52 has a first end portion 54 and second end portion 56 corresponding to the end portions 28,30 of the housing 22. Preferably, the sleeve 52 is slightly longer than the housing 22, such that it protrudes therefrom at each end portion 28,30 thereof. the sleeve 52 may be manufactured from any of a number of materials, like the housing 22, such as metal or plastic.

The gear means 82 preferably includes a gear 58 located at the second end portion 56 of the inner sleeve 52. Preferably, the gear 58 comprises a diametrically enlarged portion of the sleeve 52, having a number of teeth on its edge 59. As illustrated, the enlarged gear 58 creates a shelf 60 which engages the end of the housing 22.

The gear means 82 preferably also includes transfer gears in the form of first and second gears 48,50 aligned in axial fashion with one another and located on one of the forks 40a. The second gear 50 is designed for mating engagement with the gear 58 on the sleeve 52. As illustrated, the second gear 50 has a relatively small diameter of about 4–5 mm, and is oriented such that it rotates about an axis transverse to the centerline 62 of the housing 22. The second gear 50 is preferably about 1–2 mm in thickness, and has about 10 teeth. The number of teeth and their size and spacing are preferably chosen such that this second gear 50 and the gear 58 on the inner sleeve 52 mesh together smoothly. Further, the size and location of the second gear 50 is preferably chosen such that when the gears 58,50 engage one another, the gear 58 on the sleeve 52 is securely positioned between the end of the housing 22 and second gear 50.

The second gear 50 is preferably rotated by the first gear 48. The first gear 48 is preferably larger and thinner than the second gear 50. The first gear 48 is preferably about 10–11 mm in diameter, and only about 0.3–0.5 mm in thickness. The first gear 48 is preferably attached or otherwise connected to the second gear 50, and is preferably located between the second gear 50 and fork **40*a*. Both gears 48,50 preferably rotate about a short pin, axle, or the like passing into or through the fork 40*a***.

Lastly, the gear means 82 includes a third gear 46 which is preferably located on the axle 38 supporting the wheel 24. This gear 46 preferably meshes with the first gear 48. The third gear 46 is preferably about 1–2 mm long, so that it fits between the fork **40*a* and the wheel 22 on the axle 38. The third gear 46 is preferably about 3–4 mm in diameter, having about 6 teeth thereon. Again, the number of teeth and their size and spacing are selected so as to provide smooth interengagement with the teeth on the first gear 48. Of course, it would be possible to form gear 46 directly as a portion of wheel 24**.

When the gears 46,48,50 have the sizes described above, the first and second gears 48,50 rotate about an axis approximately 6 mm longitudinally along the fork **40*a* from where the axle 38 engages the fork 40*a***.

Of course, it is understood that while the above configuration of gears means 82 has been described as mounted about fork 40*a*, the gears could be located on the opposite side about fork 40*b*. Further, each gear 46,48,50 may be made of any of a number of materials. In particular, the gears 46,48,50 may be manufactured from metal or plastic, and may be molded, extruded, or machine formed, as known to those skilled in the art.

Most preferably, biasing means 64 are provided for pressing the crayon 23 into engagement with the transfer wheel 24. In particular, the means 64 for biasing preferably comprises first and second rods 65,66, a spring 68, and a crayon holding member 70.

The rods 65,66 are preferably solid, elongate columns. The first rod 65 has a first end portion 72 and second end portion 73. The second rod 66 has a first end portion 74 and second end portion 75 as well. The second end portion 73 of the first rod 65 is connected to the first end portion 74 of the second rod 66. When connected together, the total length of the rods 65,66 is preferably at least as long as the housing 22, so that a portion of the first end portion 72 of the first rod 65 extends from the housing 22. Further, the outer diameter of the rods 65,66 is smaller than the inner diameter of the inner sleeve 52, to permit insertion of the rods 65,66 into the sleeve 52.

The spring 68 is preferably connected to the second end portion 75 of the second rod 66. As illustrated, the spring 68 is connected to the rod 66 by fitting it over a tapered portion of the rod 66 at the second end portion 75.

The crayon engaging member 70 is connected to the spring 68 at the end of the spring opposite its connection to the rod 66. The crayon engaging member 70 preferably has a recess 76 opposite the end connected to the spring 68. The recess 76 is preferably sized to allow either end of a crayon 23 to fit therein and so that when the crayon 23 is therein it is engaged by the crayon engaging member 70.

Means 78 for locking the rods 65,66 in the sleeve 52 are preferably provided. Preferably, the means 78 for locking comprises an offset cam mechanism. In particular, it is desired that the second rod 66 be moveable from a first position in which it is aligned with the first rod 65, to a second position in which it is offset from the first rod 66.

This is accomplished by connecting the two rods 65,66 with a pin 79 which is parallel to the centerline of rods 65,66, and which is similarly offset from the centerlines of both rods 65,66. In this fashion, as illustrated in FIG. 2, the first rod 65 can be turned to a position in which it is out of alignment from the second rod 66. On the other hand, the first rod 65 can be turned to a position in which it aligns substantially with the second rod 66.

When the first rod 65 is aligned with the second rod 66, both rods are easily inserted into the sleeve 52. Once in the sleeve 52, twisting of the first rod 65 moves it out of alignment with the second rod 66, wedging the two rods 65,66 in the sleeve.

Preferably, in order to provide the friction necessary to keep the rods 65,66 in a locked position, at least one band 80 of high friction material is located on the outside of each rod 65,66. In the preferred form, the band 80 comprises a small strip of rubber or other high friction material wrapped about the rod 65,66. At least one band 80 is preferably located on either side of the connection point between the two rods 65,66 near the pin 79. Other bands 80 may be located towards the first end portion 72 of the first rod 65 and/or towards the second end portion 75 of the second rod 66.

Use of the drawing implement of the present invention is now described in conjunction with FIGS. 1–4. First, with the rods 65,66 removed from the inner sleeve 52, the user inserts the crayon 23 inserted into the sleeve 52. Preferably, the crayon 23 is placed in the sleeve 52 such that the "flat" end thereof faces towards the transfer wheel 24.

The user presses the crayon 23 downwardly in the sleeve 52 towards the wheel 24. The user then inserts the rods 65,66 when they are aligned with one another, grasping the second end portion 72, pressing them into the sleeve 52. The user presses the rods 65,66 into the sleeve 52 until resistance is met as the crayon 23 presses against the wheel 24 and the spring 68 begins to compress. The user then adds the desired amount of compression to the spring and locks the rods 65,66 into the sleeve 52 by twisting the second end portion 72 of the first rod 65.

As described above, twisting of the rod 65 rotates the rod until the means 78 for locking, in the form of the offset cam mechanism, causes the bands 80 on each rod 65,66 to engage the inner wall of the sleeve 52, frictionally binding the rods 65,66 in the sleeve 52. The high friction bands 80 on the rods 65,66 prevent them from twisting backwardly out of engagement with the sleeve 52, or otherwise sliding upwardly out of the sleeve 52.

The user then grasps the housing 22, pressing the wheel 24 into engagement with a drawing surface 53. The user then moves the implement 20 along the surface 53 by rolling the wheel 24 across it, drawing the intended design.

Most advantageously, as the wheel 24 rolls, it removes crayon material from the crayon 23 and transfers it to the surface 53. Further, the means 26 for rotating rotates the crayon 23 during use of the implement 20, preventing the wheel 24 from wearing a pattern into the crayon 23.

In particular, as the wheel 24 rotates along the surface, it turns the third gear 46. The third gear 46 turns the first gear 48, which in turn rotates the second gear 50. As the second gear 50 rotates, it turns the gear 58 on the sleeve 52, rotating the sleeve and crayon 23 therein. Under normal conditions, even without the crayon holding member 70, the crayon 23 will rotate with the sleeve 52 because of the crayon's interengagement with the inner surfaces of the sleeve. However, engagement of the crayon 23 with the holding member 70 (which is connected to the rods 65, 66 that are securely anchored in the sleeve 52) ensures that the crayon 23 rotates with the sleeve 52.

Rotation of the crayon 23 about an axis corresponding to a longitudinal centerline of the crayon 23 as the wheel 24 turns ensures that a groove or other pattern is not worn into the end of the crayon 23. Instead, the crayon 23 is worn evenly at its end, no matter what size of wheel 24 (or sleeve 36 thereon) is used. Clearly, if wheel 24 (or sleeve 26) is wider than the crayon 23, uneven wear is not a significant problem, as the end of the crayon 23 is fairly uniformly worn off. On the other hand, if the wheel 24 (or sleeve 36) is narrower than the crayon 23, unless the crayon 23 is rotated, the wheel 24 (or sleeve 36) forms a deep groove in the crayon 23, ultimately ruining it. If the wheel 24 were to dig deep enough into the crayon 23, the crayon 23 will eventually interfere with the remainder of the implement, locking the wheel 24 and preventing it from turning. The means 26 for rotating the crayon 23 eliminates this problem completely.

As the crayon 23 is used up, the spring 68 on the rod 66 expands, continually pressing the crayon 23 into engagement with the wheel 24.

The user can simply and easily change crayons 23. In the embodiment described above, the user unlocks the rods 65,66 by twisting the first end portion 72 of the first rod 65 in a direction reverse to that which locked it, aligning the two rods 65,66. The rods 65,66 are then removed from the sleeve 52. The user tips the housing 22 upside down, and the crayon 23 falls out. A different crayon 23 can then be inserted.

Figure 5:
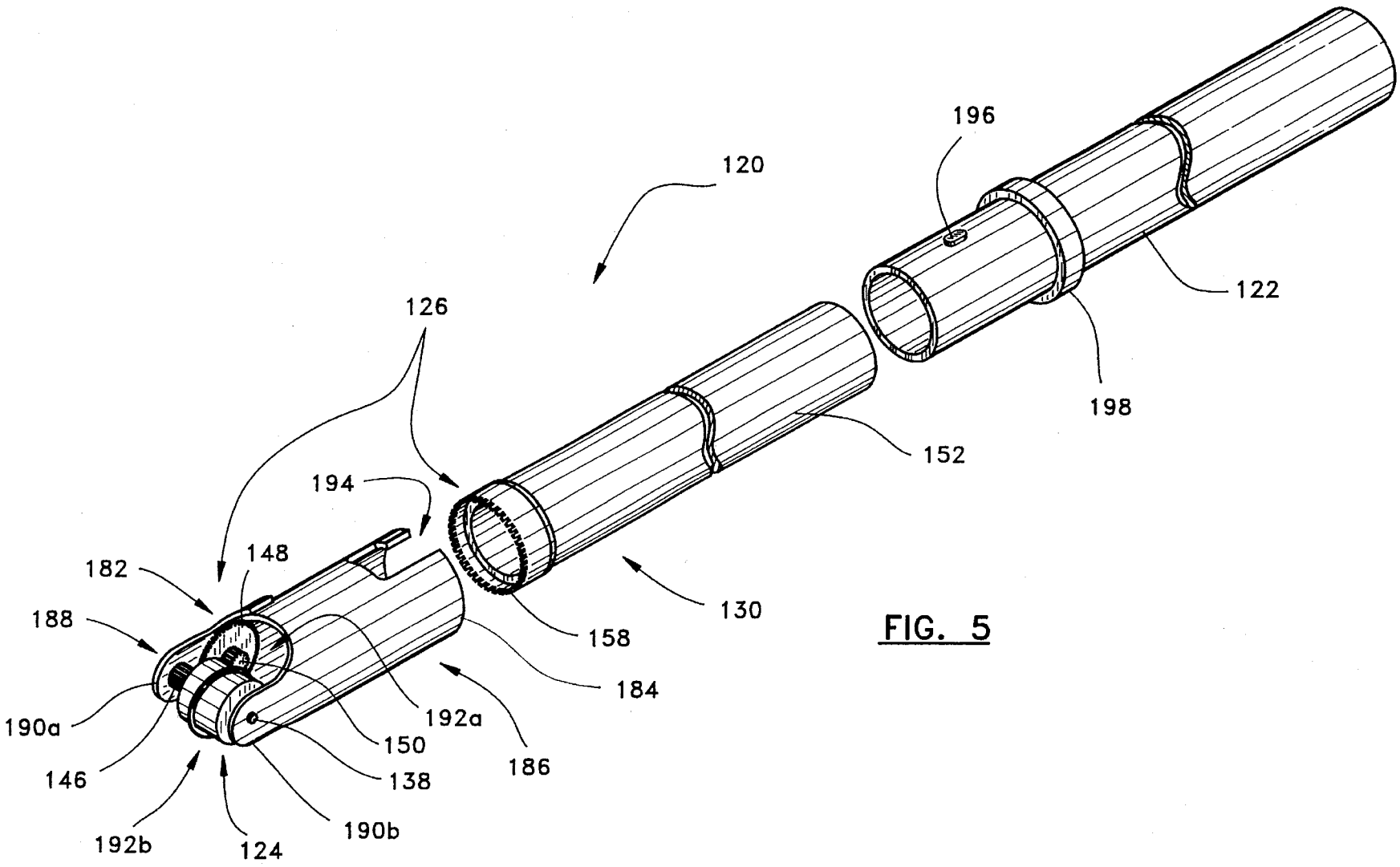
FIG. 5 illustrates an exploded view of an alternate embodiment of a drawing implement of the present invention.

An alternate embodiment implement 120 of the present invention is illustrated in FIG. 5. This embodiment of the implement 120 is substantially the same as the implement 20 described above, except that it includes a quick-change transfer wheel 124.

As illustrated, the implement 120 includes a similar housing 122 and rotating means 126 similar to those described in the first embodiment. The means 126 for rotating includes gear means 182 in the form of a first gear 148, second gear 150 and third gear 146, and an inner sleeve 152 having a gear 158 located at an end portion 130 thereof. Further, the transfer wheel 124 is located on an axle 138.

In this alternate embodiment, however, the forks 40*a,b* comprise a tubular support member 184 which is removably engageable with the housing 122. In particular, the member 184 preferably has a first end portion 186 and second end portion 188, and has an inner diameter slightly greater than the outer diameter of the housing 122. A stop 198 in the form of an extending collar may also be located on the housing 122 for engaging the member 184 and indicating to the user when the member 184 is fully on the housing and should be turned and locked into place.

The second end portion 188 includes two fingers 190*a,b* and two recesses 192*a,b* therebetween. The axle 138 is supported between the two extending fingers 190*a,b*, and the transfer wheel 124 rotates within the two recesses 192*a,b* of member 184.

The first end portion 186 includes a groove 194 for engagement with a pin 196 located on the housing 122. The pin 196 is preferably a portion of the housing 122 which extends outwardly therefrom. The groove 194 is preferably a section of material removed from the member 184 and which is designed to engage the pin 196 when the member 184 is pressed and twisted onto the housing 122.

The housing 122 may include a ramped portion near the stop 198. This portion may be used to prevent rotation of the member 186. This prevents the groove 184 from aligning with the pin 196 and then having the member 186 turn until the member can fall off of the housing 122. The ramped portion can merely be a raised portion on the housing 122 which creates frictional binding between the housing 122 and member 184 to counteract any twisting force during use of the implement 120 which acts on the member 184.

A user of the implement 120 illustrated in FIG. 5 can easily disengage the wheel 124 from the housing 122 by unlocking the member 184 from the housing 122. In particular, a user may desire to either replace a crayon with another, or interchange the wheel 124 with another. Interchangeability of the wheel 124 allows the user of the device to make an infinite variety of patterns based on different wheel/sleeve patterns and sizes.

A user removes the wheel 124 by first twisting the member 184 to align the pin 196 with an elongate portion of the groove 194, and then pulls the member off of the housing 122. The user can then insert different crayon (thus bypassing the need to remove the rods located in the other end of the sleeve 152) or can attach a completely different member 184 having a completely different transfer wheel 124 (and/or sleeve 36 thereon).

Of course, there are numerous means by which the transfer wheel 124 could be arranged so as to be removable. First, the member 184 need not engage the housing 122 in the fashion described above, nor be shaped as described above. The member 184 could simply comprise individual fork members having prongs or the like engaging notches in the housing 122, could clip onto the housing, could snap fit, or even screw onto the housing. Further, it is possible to form the implement 20,120 so that the axle 38, 138 with the wheel 24,124 thereon can be removed from the device. For example, the axle 38,138 might ride in a notch on the forks 40*a,b*/member 184 and be lockable therein until a user is ready to remove it from the housing 22,122.

It will be understood that the above described arrangements of apparatus and the method(s) therefrom are merely illustrative of applications of the principles of this invention and many other embodiments and modifications may be made without departing from the spirit and scope of the invention as defined in the claims.

I claim:

1. A drawing implement for transferring a drawing material onto a drawing surface comprising:

an elongate tubular housing, having a first end portion and second end portion and a centerline running therethrough, for housing a rod of semi-solid drawing material;

a material transfer wheel mounted adjacent the second end portion of said housing for rotation about an axis running perpendicular to said centerline of said housing for removing drawing material from said rod of drawing material and depositing it on the drawing surface; and means for rotating said rod of drawing material with respect to said wheel and about an axis parallel to said centerline of said housing.

2. The drawing implement of claim 1, wherein said means for rotating includes an inner sleeve located within said housing for containing said rod of drawing material, said sleeve rotatable with respect to said housing about said centerline of said housing.

3. The drawing implement of claim 2, wherein said means for rotating includes gear means connecting said inner sleeve and said transfer wheel for rotation of said sleeve and said rod of drawing material therein with respect to said housing upon rotation of said wheel.

4. The drawing implement of claim 1, wherein said means for rotating comprises a gear located on an axle supporting said wheel, a sleeve located within said housing and having a gear located at an end portion thereof, and one or more transfer gears in engagement with said gear on said axle and said gear on said sleeve.

5. The drawing implement of claim 1, further including means for locking said rod of drawing material in said implement.

6. The drawing implement of claim 5, wherein said locking means comprises first and second rods, one of which has a spring connected thereto.

7. The drawing implement of claim 6, wherein said rods include an offset cam mechanism for locking said rods in said implement.

8. The drawing implement of claim 1, further including forks extending from said housing, and wherein said wheel is located on an axle supported by said forks.

9. The drawing implement of claim 1, wherein said transfer wheel has an outer material-engaging surface and a sleeve is selectively located on said outer surface of said transfer wheel.

10. A drawing implement for transferring a drawing material to a drawing surface, comprising:

an elongate outer housing having a first end portion and second end portion and a centerline therethrough;

a sleeve located within said housing, said sleeve having a first end portion and second end portion, said second end portion of said sleeve extending outwardly from said second end portion of said housing and having a gear thereon;

a pair of forks, each fork having a first end portion connected to said second end portion of said housing and a second free end portion;

an axle spanning said forks between their free end portions and extending perpendicular to said centerline of said housing;

a transfer wheel located on said axle for contacting said drawing material and said drawing surface;

gear means contacting said gear on said sleeve and said axle; and locking means for locking said drawing material in said sleeve.

11. The implement of claim 10, wherein said locking means comprises first and second rods.

12. The implement of claim 10, wherein said locking means comprises at least one rod having a spring thereon.

13. The implement of claim 10, wherein said transfer wheel has an outer material-engaging surface and a sleeve is selectively located on said outer surface of said transfer wheel.

14. The implement of claim 10, wherein said gear means comprises first and second gears aligned in axial arrangement connected to one of said forks, said first gear contacting said gear on said sleeve; and a third gear located on said axle near one of said forks contacting said second gear located on said fork.

15. A mechanism for use in transferring material from a rod of drawing material located in a drawing implement including an inner sleeve positioned in an outer housing comprising:

a support member having a first end portion designed for selective attachment to said housing and a second free end portion;

an axle spanning said second free end portion of said support member;

a transfer wheel located on said axle for contacting said drawing material and a drawing surface; and means for rotating located on said member for connection with said implement for rotating said material with respect to said wheel.

16. The mechanism of claim 15, wherein said means for rotating comprises gear means located on said member for engagement with a gear located on said sleeve.

17. The mechanism of claim 15, wherein said wheel has an outer surface and further including a sleeve located on said outer surface of said wheel.

18. The mechanism of claim 15, further including a first gear located on said axle, and second and third gears located on said member in axial arrangement, one of said gears engaging said first gear and the other engaging a gear located on said sleeve.

19. The mechanism of claim 15, wherein said member includes a groove therein for selective engagement with a pin on said housing.

* * * * *